US006893100B1

(12) United States Patent
Hottmann et al.

(10) Patent No.: US 6,893,100 B1
(45) Date of Patent: May 17, 2005

(54) METHODS AND APPARATUS FOR AUTOMATED BRUSH ASSEMBLY

(75) Inventors: Wendell M. Hottmann, Cottage Grove, WI (US); Alan F. Kubinski, Rockford, IL (US); Victor McConnell, Rockford, IL (US); Keith Miller, Marine on the St. Croix, MN (US); Rex E. Reinking, Cedar Rapids, IA (US); Bernd Stein, Schmitten (DE)

(73) Assignee: Gillett Canada Company, Halifax (CA)

( * ) Notice: Subject to any disclaimer, the term of this patent is extended or adjusted under 35 U.S.C. 154(b) by 529 days.

(21) Appl. No.: 09/665,254

(22) Filed: Sep. 19, 2000

(51) Int. Cl.[7] ..... A46D 3/08
(52) U.S. Cl. ..... 300/7; 300/5; 425/805
(58) Field of Search ..... 300/2, 7, 10, 11, 300/4, 5, 8, 21; 425/126.1, 805

(56) References Cited

U.S. PATENT DOCUMENTS

| | | | | |
|---|---|---|---|---|
| 2,015,326 A | | 9/1935 | Steidle | |
| 2,125,735 A | * | 8/1938 | Morrison | 300/2 |
| 2,187,791 A | | 1/1940 | Lipps | |
| 2,643,158 A | * | 6/1953 | Baldanza | 264/243 |
| 3,610,692 A | * | 10/1971 | Van der Molen | 300/21 |
| 4,310,377 A | | 1/1982 | Lorenz | 156/499 |
| 4,444,711 A | | 4/1984 | Schad | 264/243 |
| 4,535,014 A | | 8/1985 | Wright | 264/246 |
| 4,609,228 A | | 9/1986 | Bickel | 425/805 |
| 4,688,857 A | | 8/1987 | Boucherie | 300/7 |
| 4,697,851 A | | 10/1987 | Takahashi | 300/1 |
| 4,756,579 A | | 7/1988 | Boland et al. | 300/21 |
| 4,884,849 A | | 12/1989 | Shaw | 300/4 |
| 4,885,121 A | | 12/1989 | Patel | 264/255 |
| 4,954,305 A | | 9/1990 | Weihrauch | 425/805 |
| 4,979,782 A | | 12/1990 | Weihrauch | 300/4 |
| 5,045,267 A | * | 9/1991 | Weihrauch | 264/243 |
| 5,104,196 A | | 4/1992 | Boucherie | 300/5 |
| 5,143,424 A | | 9/1992 | Boucherie | |
| 5,148,568 A | | 9/1992 | Bojar et al. | 300/21 |
| 5,163,348 A | | 11/1992 | Kitada et al. | 83/13 |
| 5,176,427 A | | 1/1993 | Weihrauch | 300/10 |
| 5,221,123 A | | 6/1993 | Klinkhammer | 300/2 |
| 5,256,048 A | | 10/1993 | Jacobs et al. | 425/130 |
| 5,352,025 A | | 10/1994 | Huang | 264/243 |
| 5,390,984 A | * | 2/1995 | Boucherie et al. | 300/21 |
| 5,431,484 A | | 7/1995 | Zahoransky et al. | 300/2 |
| 5,458,400 A | | 10/1995 | Meyer | 264/243 |
| 5,474,366 A | | 12/1995 | Strütt et al. | 300/21 |
| 5,533,791 A | | 7/1996 | Boucherie | 300/4 |
| 5,536,458 A | | 7/1996 | Kawakita et al. | 264/46.6 |

(Continued)

FOREIGN PATENT DOCUMENTS

| | | |
|---|---|---|
| DE | 2 308 399 | 8/1974 |
| DE | 91 07 687.0 | 8/1991 |
| DE | 195 25 808 | 1/1997 |
| GB | 247688 | 2/1926 |

*Primary Examiner*—Robert Davis
(74) *Attorney, Agent, or Firm*—David A. Howley

(57) ABSTRACT

Methods and apparatus for automated brush assembly are disclosed. A method of end-rounding bristle ends with an abrasive surface in random orbital motion relative to bristle tufts held in a movable gripper is described. A novel tuft carrier adapted to hold a plurality of bristle tufts in an arrangement suitable for direct mechanical insertion into the tuft chambers of a brush mold is also described. The tuft carrier has a plurality of tuft insertion cavities and a plurality of movable clamps, each clamp adapted to at least partially occlude one of the cavities when closed. Individual bristle tufts, having a fused end and a rounded or non-rounded bristle end, are transferred from a movable gripper to the tuft carrier by direct mechanical insertion. In addition, an apparatus for direct mechanical insertion of bristle tufts from a tuft carrier into the tuft chambers of a brush mold is described.

6 Claims, 5 Drawing Sheets

U.S. PATENT DOCUMENTS 5,588,714 A 12/1996 Boucherie ..... 300/21
5,609,890 A 3/1997 Boucherie ..... 425/126.1
5,728,408 A 3/1998 Boucherie ..... 425/126.1
5,743,306 A * 4/1998 Stewart et al. ..... 139/7 A
5,761,759 A 6/1998 Leversby et al. ..... 425/129.1
5,823,633 A 10/1998 Weihrauch ..... 300/21
5,863,102 A 1/1999 Waguespack et al. ..... 300/11
5,927,819 A 7/1999 Philipp et al. ..... 300/11
6,439,669 B1 * 8/2002 Reilly ..... 300/2

* cited by examiner

METHODS AND APPARATUS FOR AUTOMATED BRUSH ASSEMBLY

FIELD

The invention relates to manufacturing brushes, and in particular to manufacturing toothbrushes using automated assembly methods.

BACKGROUND

Brushes generally include a brush body that includes a handle portion and a head portion, and tufts of bristles attached to the brush body at or near the head portion. A toothbrush is a particular type of brush that has a head portion adapted for use within the oral cavity to remove food residues and plaque from tooth surfaces, the gums and the gingiva.

Toothbrush bodies usually are made with injection molding machines. Toothbrush bodies often consist of plastic or other polymeric materials, and frequently include multiple components. The different components may differ in nature, color, texture, density, and hardness. For example, toothbrush bodies may include a relatively hard plastic base component and a colored, compliant rubber gripping component.

The bristles of the toothbrush are made from filaments. Polymeric materials, such as nylon, commonly are used in fabricating the bristle filaments. In some toothbrush manufacturing processes, filaments are provided in the form of a hank that is circular in cross section, has a length ranging from a few centimeters to several meters, and includes a band around its circumference. The band holds the filaments together.

Prior to incorporation into the toothbrush, the hanks, and thus the filaments, are cut to a length of a few centimeters. The band is subsequently removed and one end of the filaments is fused to form a bristle tuft. Prior to fusing, the short filaments can be difficult to handle, particularly when subjected to additional processing steps. Even after fusing to form a bristle tuft, the tufts can be difficult to handle in various processes used to round bristle ends or to attach the bristle tufts to the brush head.

SUMMARY OF THE INVENTION

In one aspect, the invention features a method of forming end-rounded bristle tufts. The method involves the steps of:

providing a plurality of bristles formed into a plurality of tufts, wherein each tuft has a first end and a second end;

providing a movable gripper adapted to open and close, wherein the gripper, when closed, is capable of maintaining a plurality of bristle tufts in fixed position relative to each other;

opening the gripper;

gathering a plurality of bristle tufts in the open gripper;

closing the gripper, whereby at least one of the first or second ends of each of the tufts remains exposed;

moving the closed gripper to engage an end of each of the tufts into contact with an abrasive surface adapted to move in relative motion to the gripper; and maintaining contact of the tuft end with the abrasive surface for a time sufficient to substantially round bristles at the end of each tuft.

In certain embodiments, the first and second ends of each tuft remain exposed after closing the gripper. In other embodiments, the method may include the additional step of fusing one of the ends of each tuft. The method may also include the additional step of inspecting at least one of the first or second ends of each tuft after closing the gripper.

Preferably, the abrasive surface contains abrasive particles having a mesh size of 320 or finer. The abrasive particles may be selected from the group consisting of aluminum oxide, silicon carbide, and silicon nitride.

In other preferred embodiments, the abrasive surface is moved in an orbital motion relative to the gripper. The abrasive surface may, simultaneously with the orbital motion, be moved in a rotary motion relative to the gripper. The abrasive surface is preferably moved in an orbital motion at a rate between 200 and 2000 revolutions per minute relative to the gripper, and is preferably moved in a rotary motion at a rate between 1 and 100 revolutions per minute relative to the gripper. The abrasive surface may preferably comprise an abrasive disk.

In another aspect, the invention features a tuft carrier. The tuft carrier includes a body having an upper face, a plurality of side faces, and a lower face. The body defines a plurality of cavities extending between the upper and lower faces. The tuft carrier further contains a plurality of movable clamps connected to the body, wherein each of the clamps is adapted to move in relation to one of said cavities at the upper or lower face. Each clamp is adapted to allow a tuft to be inserted into a cavity when the corresponding clamp is opened, and to at least partially occlude the cavity when the clamp is closed, thereby holding a bristle tuft within the cavity when the clamp is moved to at least partially occlude the cavity. In preferred embodiments, the cavities are linearly arranged. The cavities may be tapered between the upper face and the lower face. The cavities may have any desired shape, including, in preferred embodiments, oval, triangular, or rectangular shape In other preferred embodiments, the clamps are spring loaded. Each clamp may preferably define an opening, and each of the clamps may be adapted to permit alignment of the opening with one of the cavities when the clamp is open.

The tuft carrier may further include a keyway.

In still another aspect, the invention features a tuft stitching apparatus. The apparatus includes:

a movable stitching head comprising a pushpin guide defining a channel, a retractable push pin positioned coaxially within the channel, a tuft feed adapted for positioning a tuft under the pushpin guide and coaxial with the push pin and the channel, and a drive connected to the push pin, wherein the drive is adapted to retract or advance the push pin within the channel of the pushpin guide;

a movable tuft insertion guide comprising a body having upper and lower faces and a cavity extending between the upper and lower faces, the guide adapted to position the upper face in contact with the stitching head such that the cavity is coaxial with the pushpin and the channel; and a movable mold positioning fixture adapted to work in combination with the head and the guide to position a brush mold having a plurality of tuft insertion chambers such that the pushpin, the pushpin guide, and the cavity are simultaneously coaxial with one of the tuft insertion chambers.

The tuft feed of the tuft stitching apparatus preferably contains a screw feed. The tuft feed also preferably contains a movable tuft carrier, and the movable tuft carrier preferably contains a keyway adapted to engage with the screw feed. The tuft carrier preferably defines a plurality of cavities wherein each cavity is adapted to hold a tuft. The tuft stitching apparatus preferably includes a sensor to detect empty cavities in the tuft carrier.

In still another aspect, the invention features a method of forming a tufted brush head in a brush mold. The method includes the steps of:

providing a brush mold wherein the mold defines a brush head cavity, and the brush head cavity defines a plurality of tuft insertion cavities;

providing a plurality of bristles as tufts held in a movable gripper, wherein each of the bristles and each of the tufts has two ends;

transferring the tufts to a movable tuft carrier having a top face, a bottom face, and a plurality of cavities extending between the faces, wherein the carrier is adapted to hold a plurality of tufts as an arrangement of individual tufts within the cavities;

moving the mold and the tuft carrier to a tuft stitching apparatus adapted to mechanically transfer the tufts to the tuft insertion cavities; and mechanically transferring at the tuft stitching apparatus at least one of the tufts from the carrier to at least one of the tuft insertion cavities.

The method may preferably further comprise any of the following steps: fusing at least one end of each tuft; fusing one end of each tuft while the tufts are held in the gripper; end-rounding at least one end of the bristles while the tufts are held in the gripper; pushing one end of the tufts within the carrier such that each tufts is made substantially flush with a face of the carrier; temporarily storing the tuft carrier in a tuft carrier buffer before moving the tuft carrier to the tuft stitching apparatus; or inspecting the tufts for defects while the tufts are held in the gripper.

In those embodiments wherein tufts are inspected for defects while the tufts are held in the gripper, the method preferably further comprises the step of removing any defective tufts from the tuft carrier before moving the tuft carrier to the tuft stitching apparatus.

In yet another aspect, the invention features a method of forming a brush assembly. The method includes the steps of:

providing a brush mold defining a plurality of tuft insertion cavities;

providing a plurality of tufts arranged in a movable gripper;

transferring the tufts from the gripper to a movable tuft carrier; transferring at least one tuft from the tuft carrier to at least one of the tuft insertion cavities by direct mechanical insertion, whereby a single tuft is inserted in each of the tuft insertion cavities.

adding a polymer having a melting point to the brush mold at a temperature above the melting point;

cooling the mold to a temperature below the melting point; and removing a completed brush assembly from the brush mold.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
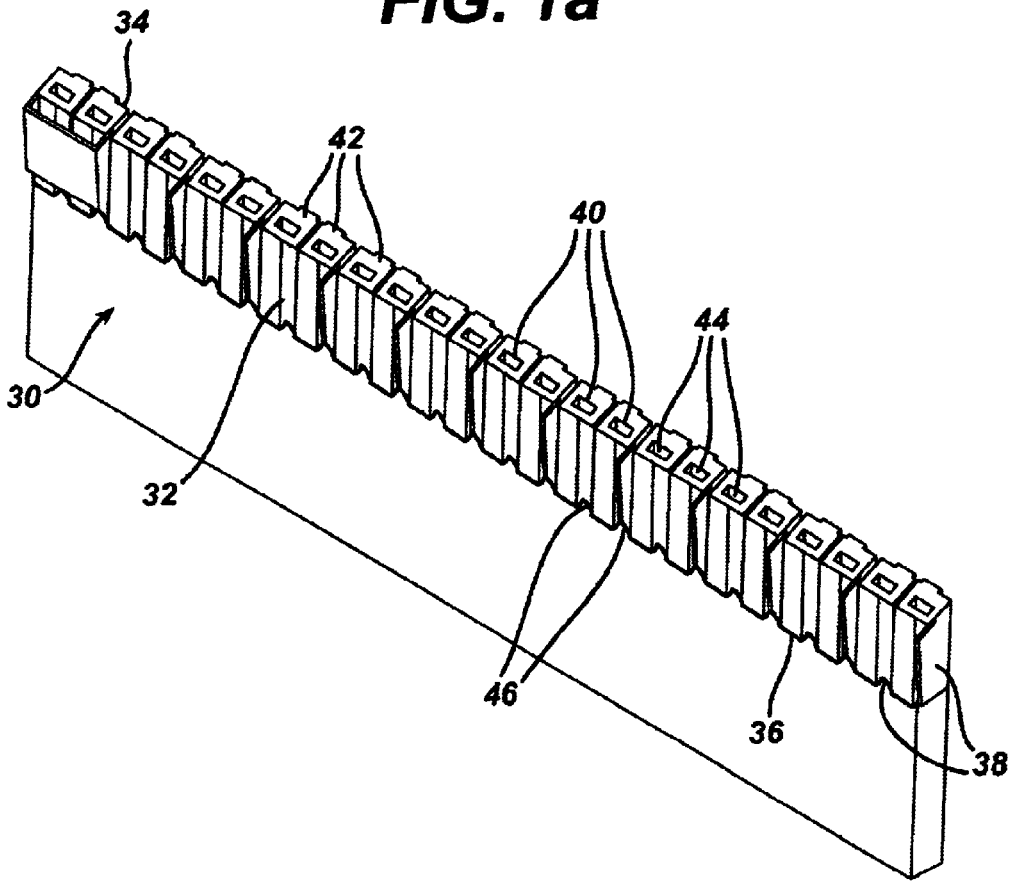
FIG. 1*a* is a perspective view of a tuft carrier in accordance with the invention, showing a top face, a plurality of tuft cavities, a plurality of movable tuft clamps, and a keyway.

In most brush forming processes, hanks of bristle-forming filaments are gathered, cut to a desired length, fused at one end to create a bristle tuft, and optionally, subjected to an end-rounding process. A toothbrush assembly is formed by attaching a plurality of end-rounded bristle tufts to a brush body by, e.g. stapling, adhesively bonding, thermally bonding the fused end of the tufts to the brush body. Generally, the fused ends of the bristle tufts are inserted into tuft cavities created in the brush head. Alternatively, the tufts may be pneumatically inserted into tuft chambers in a brush mold, with subsequent addition of molten polymer and cooling of the mold below the polymer melting point to form a brush assembly. Tufts may be retained in the brush assembly by a lock formed around a melted tuft end when molten plastic is flowed around the tuft end and cooled.

In known processes for manufacturing brushes, the loose bristles are formed into bristle tufts using the following process steps:

(A) Precut bristle filament is gathered from a filament buffer by a linear-stroking picker bar with multiple picker eyes. The number of eyes usually corresponds to the number of tufts for one brush head for the respective tuft type and brush size. Each picker eye gathers the appropriate amount of filament and holds it in the correct shape and orientation for the subsequent process steps.

(B) A pick and place mechanism grips the gathered tufts, removes them from the picker bar and loads them onto a rotary indexing rotary dial station. Once loaded, the tufts undergo the following operations at the respective index station:

Tamping Station—The tufts are tamped so that the ends of the tufts are uniform.

Prefusing Station—At the prefusing station the tops of the filaments are fused together. This forms a complete tuft and allows it to maintain its size and shape through the tuft insertion process.

Blow Station—Here the tufts are mechanically ejected from the rotary indexing dial and are pneumatically transported through transport tubes to an insertion head positioned at the brush mold.

Such conventional methods of forming bristle tufts are not well-suited for use in automated brush assembly methods, and are known to lead to a high proportion of misformed and missing bristle tufts at the brush mold.

The present invention relates to improved methods and devices useful in automated brush assembly.

In one aspect, the invention provides a method of forming end-rounded bristles while bristles tufts are held in a gripper.

In the production of toothbrushes, it is known to round the non-fused ends of the individual brush bristle tufts using a variety of abrasion and grinding techniques. End-rounding by grinding or abrasion may be effected either before or after the tufts are attached to the brush body. Rounded bristles improve cleaning effectiveness and reduce irritation to the gums and gingiva in oral hygiene maintenance. Known end-rounding processes are, however, poorly suited for use in automated brush assembly processes. In addition, end-rounding processes that use a rotary abrasion method are known to result in wear patterns on the abrasive surface, requiring frequent replacement of the abrasive in order to maintain end-rounding efficiency. Even with fresh abrasive material, rotary end-rounding processes produce a significant number of tufts having bristle ends that are non-uniformly rounded, leading to a high proportion of rejected tufts in the brush assembly process.

In accordance with the inventive method of forming end-rounded bristles, a movable gripper is provided to simultaneously form a plurality of bristle tufts and to transport the tufts from a first tuft processing station to a second tuft processing station. At each station a variety of processes can occur including, e.g., fusing, end rounding, shaping, cutting, tufting, inspection and combinations thereof.

The movable gripper is used to form bristle tufts from hanks of bristle-forming material. The movable gripper generally includes two gripper elements, e.g., jaws arranged in a plane and capable of moving from a first open position to a second closed position. In the closed position, the gripper is capable of gripping a number of bristle tufts, wherein the tufts may include fused ends, unfused ends or a combination thereof. In certain embodiments, the first and second ends of each tuft remain exposed after closing the gripper. In other embodiments, only one end of each tuft remains exposed after closing the gripper.

Suitable grippers are disclosed in co-pending U.S. patent application Ser. No. 09/386,879, titled "Filament Gripper," filed on Aug. 31, 1999, and now U.S. Pat. No. 6,439,669B assigned to a common assignee, and incorporated herein by reference. The gripper includes a means for moving the gripper jaws from an open position to a closed position. Examples of useful gripper moving means include actuators, e.g., pneumatic, electric, and hydraulic actuators, cams, and links. As the gripper jaws close, the jaws move toward and engage each other such that bristles become sandwiched between (i.e., gripped by) the jaws. The bristles are held in position (i.e., gripped) by the jaws with a force sufficient to maintain the bristles in the gripper. When the gripper opens, the gripper jaws separate and the bristle tufts are released or are capable of being released from the gripper.

The gripper is preferably attached to a transport that is capable of moving the gripper from one position to another position. The transport can be constructed and programmed to move gripper as desired including, e.g., translationally, rotationally, vibrationally, and combinations thereof. The transport feature can be realized by, e.g., actuators that are capable of moving the gripper. Examples of suitable actuators include pneumatic, mechanical, and electrical linear actuators and rotary actuators, and combinations thereof.

In addition to simultaneously forming a plurality of bristle tufts, the gripper may also transport the tufts from a first tuft processing station to a second tuft processing station. As noted above, at each station a variety of processes can occur including, e.g., fusing, end rounding, shaping, cutting, tufting, inspection and combinations thereof.

For example, in order to fuse one end of the bristle bundle to form a tuft, a heat source, e.g., heated compressed air, is applied to an exposed end of the bristles for a period sufficient to allow the ends of the bristles to melt and fuse together. The bristle bundle is subsequently cooled. In a preferred embodiment, the heat source is removed from the bristles and the jaws are held in the fully closed position for a few seconds to allow the bristles to cool, thereby fixing the shape of the tuft. The resulting fused tufts are then available for transfer to another station for additional processing, or to an unload station where the tufts are removed from the gripper.

In the method of forming end-rounded bristles tufts of the present invention, non-fused ends of a plurality of bristle tufts are subjected to an end-rounding process while the tufts are held in a movable gripper. Thus, for example, after fusing one end of the tufts held in the gripper, the gripper assembly loaded with tufts is placed in an end-rounding rotary dial station. The rotary dial station indexes the gripper to at least one end-rounding station. In one embodiment, multiple end-rounding stations are provided. In this embodiment, the first end-rounding station preferably accomplishes coarse end-rounding, and the rotary dial subsequently indexes the gripper to a final end-rounding station that accomplishes fine end-rounding or polishing of the bristle ends.

In a preferred embodiment, bristles in the form of a plurality of tufts held in a movable gripping device are end-rounded by engaging the free ends of the bristle tufts to an abrasive surface undergoing combined rotary and oscillatory motion, e.g. random orbital motion. The improvement is particularly suited to produce bristle tufts having substantially uniform end-rounded bristles. The improved end-rounding method yields a lower proportion of non-uniform or rejected tufts, and provides for more even use of an abrasive surface. The improved method is also readily adapted for use in automated brush assembly processes.

The improved method of end-rounding bristles thus involves the following steps. A plurality of bristle tufts is provided, wherein each tuft has a first and second end. A movable gripper as discussed herein is provided, and the gripper is opened. A plurality of bristle tufts is gathered in the open gripper, and the gripper is closed such that a least one of the ends of each tuft remains exposed. The closed gripper is then moved to engage an end of each tuft into contact with an abrasive surface that is adapted to move in relation to the gripper. Contact is maintained between the tuft end and abrasive surface for a time sufficient to substantially round the bristles at the tuft end.

End-rounding is preferably accomplished using a disc coated with an abrasive grit. Preferably, the abrasive grit comprises aluminum oxide, silicon carbide or silicon nitride. Preferably, and abrasive grit having a mesh size less than 320 mesh is used. Such abrasive discs and abrasive grits are known in the art.

In other preferred embodiments, the abrasive surface is moved in an orbital motion relative to the gripper. The abrasive surface may be simultaneously moved in a rotary motion relative to the gripper. The abrasive surface is preferably moved in an orbital motion at a rate between 200 and 2000 revolutions per minute relative to the gripper, and is preferably simultaneously moved in a rotary motion at a rate between 1and 100 revolutions per minute relative to the gripper. The abrasive surface preferably comprises an abrasive disk. The disks carrying the abrasive material are most preferably rotating with 1200 rpm orbital motion (1.0" orbit) and 10 rpm internal rotation to avoid producing a wear pattern on the abrasive surface.

In one variation, the end-rounding stations are lifted to a certain extent to interfere with the tufts and then, while end-rounding is still in progress, lowered to a non-interfering home position. In a preferred embodiment, the end-rounding station remains stationary and the gripper is moved to create an interference between the free bristle ends and the abrasive end-rounding surface. After passing the end-rounding station, the gripper assembly is indexed to an unload station.

In known methods for manufacturing toothbrushes, pre-formed bristle tufts are provided as loose, individual tufts in trays. The trays, containing precut, pre-fused and end-rounded bristle tufts, are loaded manually by operators into a buffer of a pneumatic tuft insertion module. Each module holds a plurality of bristle trays in a storage magazine, which is manually loaded with new trays every few hours. The empty trays are manually collected periodically by the operators and refilled with preformed bristle tufts.

Such manual tuft collection and refilling methods are not readily adapted for use in automated brush assembly methods. In addition, such methods are not readily adapted to produce toothbrushes having end-rounded and non-rounded bristle tufts in the same brush head assembly, due to the difficulty of handling loose bristle tufts in a tray.

Therefore, another aspect of the present invention relates to a tuft carrier useful in automated brush assembly processes. The tuft carrier contains a body having an upper face, a plurality of side faces, and a lower face. The body defines a plurality of cavities extending between the upper and lower faces. The tuft carrier further comprises a plurality of movable clamps connected to the body, wherein each of the clamps is adapted to move in relation to one of the cavities at the upper or lower face, thereby opening the tuft cavity for tuft insertion when the clamp is opened, and at least partially occluding the tuft cavity at the upper or lower face when the clamp is closed.

Figure 1B:
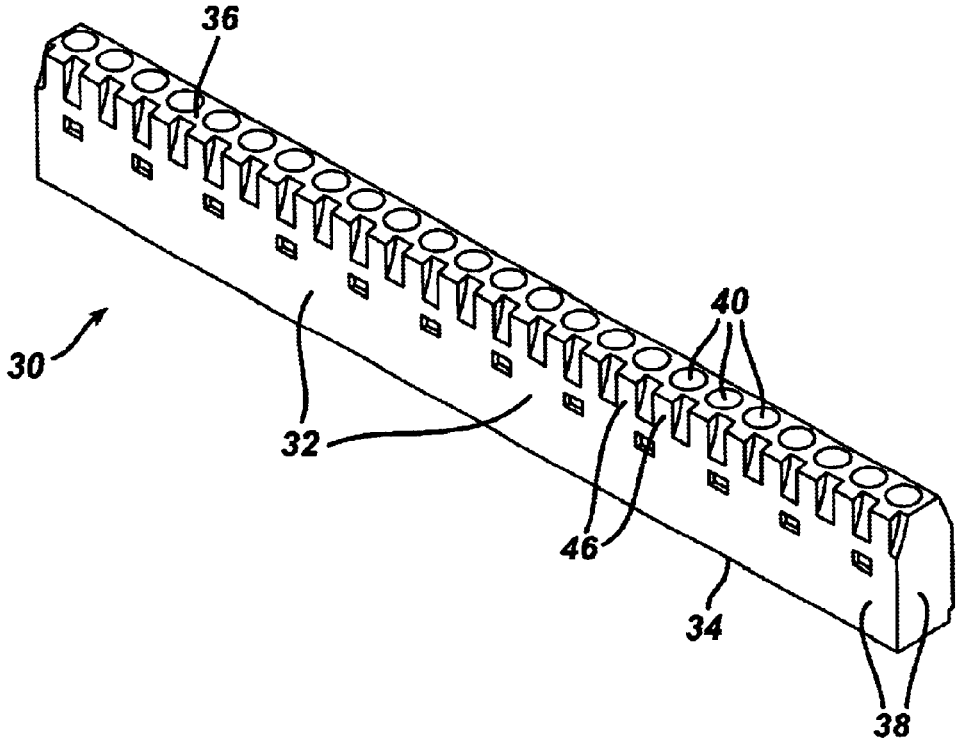
FIG. 1*b* is a perspective view of a tuft carrier in accordance with the invention, showing a bottom face, side faces, tuft cavities, and a keyway.

Referring to FIGS. 1*a* and 1*b*, two perspective views of a tuft carrier 30 in accordance with the present invention are illustrated. The tuft carrier 30 includes a body 32, an upper face 34, a lower face 36, and side faces 38. The body 32 defines a plurality of cavities 40 extending between the upper face 34 and the lower face 36. The tuft carrier 30 includes movable clamps 42. Each clamp is adapted to correspond to and move in relation to one of the cavities at the upper or lower face. The clamp is adapted such that a tuft may be inserted into a cavity when the clamp is moved to an open position. Each clamp is also adapted to at least partially occlude a tuft cavity when the clamp is closed.

In preferred embodiments, and as shown in FIG. 1, movable clamps 42 each having an opening 44 are provided in the tuft carrier 30. The opening 44 in each clamp 42 is preferably designed to align with the cavity 40 with which it corresponds. The clamps 42 are preferably spring-loaded such that in operation, a clamp may be moved against the bias of the spring load to an open position in which the clamp opening 44 is substantially aligned with the cavity 40. Each clamp preferably can be moved in relation to a cavity independent of other clamps on the tuft carrier. A bristle tuft may then be inserted, and the spring-loaded clamp released to its resting position in which the clamp partially occludes the cavity at the face of the carrier. The partial occlusion of the cavity (within which the tuft has been inserted) by the clamp holds the tuft within the cavity.

Tuft carriers in accordance with the invention preferably are constructed of a polymeric material, and may be fabricated using methods and materials known in the art, e.g. injection of molten material into a mold. The clamps may be comprised of metal or any other suitable material, and may be attached or connected to the tuft carrier body by any suitable means known in the art. The clamps preferably are attached to the tuft carrier body such that each clamp moves in relation to a cavity independently of other clamps, and such that the clamp is spring loaded with the cavity partially occluded at the upper or lower face when the spring loaded clamp is in resting position.

Each tuft cavity of the tuft carrier is adapted to receive an individual tuft from, for example, a gripping device holding a plurality of tufts, when the corresponding clamp is open. Each clamp is adapted to allow a tuft to be inserted into a cavity when the corresponding clamp is opened, and to at least partially occlude the cavity when the clamp is closed, thereby holding the bristle tuft within the cavity. Preferably, all clamps on a given tuft carrier are adapted to open and close simultaneously, permitting bristle tufts to be loaded into the tuft carrier simultaneously.

In a preferred embodiment, the cavities are arranged linearly, as shown in FIGS. 1*a* and 1*b*.

In another embodiment, the cavities are tapered between the upper face and the lower face. The shape of the cavities may be readily altered to permit use with a particular shape of bristle tuft, e.g. cylindrical or polygonal. Preferred cavity shapes include rectangular, oval, and triangular.

In a variation of this preferred embodiment, the tuft carrier may further include a keyway. The keyway is preferably situated on a side face of the tuft carrier body, oriented parallel to the linear arrangement of cavities. The keyway is adapted to engage with a tuft feed mechanism, for example a screw feed, to index the tuft carrier in order to position a particular tuft carrier cavity with respect to an external apparatus, such as a tuft rejection or tuft insertion apparatus. A keyway 46 is shown in the embodiment of the tuft carrier depicted in FIGS. 1*a* and 1*b*.

Each tuft carrier is adapted to hold a plurality of tufts in a configuration suitable for direct mechanical insertion into the tuft chambers of a brush mold.

The tuft carrier, and its use in automated brush assembly, permits positive mechanical control over the individual bristle tufts at all points after the tufts are transferred to the tuft carrier. Positive mechanical control permits direct mechanical insertion of the individual bristle tufts into the tuft chambers of a brush mold.

Previous methods for tuft insertion into the tuft chambers of a brush mold relied upon pneumatic transport and pneumatic tuft insertion. In such known pneumatic tuft insertion methods, each brush mold is located on a linear servo-indexing (x-y) table. A tuft insertion head assembly aligns each tuft chamber in the brush mold with dowel pins on the insertion head. After the pre-fused tufts are pneumatically conveyed from the tuft-forming station through transfer tubes to the insertion head, the tufts pass through the insertion head and into the brush mold. While the insertion head is still engaged with the brush mold, its upper section shuttles an array of pins that then mechanically seat the tufts in the brush mold and positively strips them from the insertion head. The brush mold is indexed and the process is repeated to complete filling of the tuft chambers of the brush mold with tufts at the tuft insertion module.

A significant limitation to production output using pneumatic tuft insertion is tuft insertion module downtime due to tuft insertion faults. This is due to the pneumatic transport of the tufts by compressed air. As soon as the tufts are inserted in the transfer tubes, all positive mechanical control over the tuft is lost. Difficulties are often encountered when inserting the bristle tufts into the tuft chambers, because direct mechanical control cannot be maintained over the individual bristle tufts. This leads to frequent process interruptions in order to clear improperly inserted tufts from the mold assembly, and often leads to completed brushes that are defective because they are missing individual tufts or have improperly installed tufts. The frequency of faults and the associated downtime significantly reduces output and increases waste and cost. Such known toothbrush manufacturing processes are also slow, and therefore poorly adapted for automated or computer-controlled assembly methods.

Accordingly, the present invention provides an apparatus and method for direct mechanical insertion of bristle tufts held in a tuft carrier into tuft chambers of a brush mold. The direct mechanical insertion method makes use of a novel tuft stitching apparatus shown in FIGS. 2–4.

In general, a tuft stitching apparatus in accordance with the invention is located at a tuft insertion station and includes a movable stitching head, a movable tuft insertion guide, and a movable mold positioning fixture. The movable stitching head includes a pushpin guide defining a channel, a retractable push pin positioned coaxially within the channel, a tuft feed adapted for positioning a tuft under the pushpin guide and coaxial with the push pin and the channel, and a drive connected to the push pin, wherein the drive is adapted to retract or advance the push pin within the channel of the pushpin guide.

The movable tuft insertion guide includes a body having upper and lower faces and a cavity extending between the upper and lower faces. The insertion guide is adapted to position the upper face in contact with the stitching head such that the cavity is coaxial with the pushpin and the channel.

The movable mold positioning fixture is adapted to work in combination with the stitching head and insertion guide to position a brush mold having a plurality of tuft insertion chambers, such that the pushpin, the pushpin guide, and the cavity are simultaneously coaxial with one of the tuft insertion chambers.

The tuft feed of the tuft stitching apparatus preferably contains a screw feed. The tuft feed also preferably contains a movable tuft carrier, and the movable tuft carrier preferably contains a keyway adapted to engage with the screw feed. The tuft carrier preferably defines a plurality of cavities wherein each cavity is adapted to hold a tuft.

The tuft stitching apparatus preferably includes a sensor to detect empty cavities in the tuft carrier.

Figure 2:
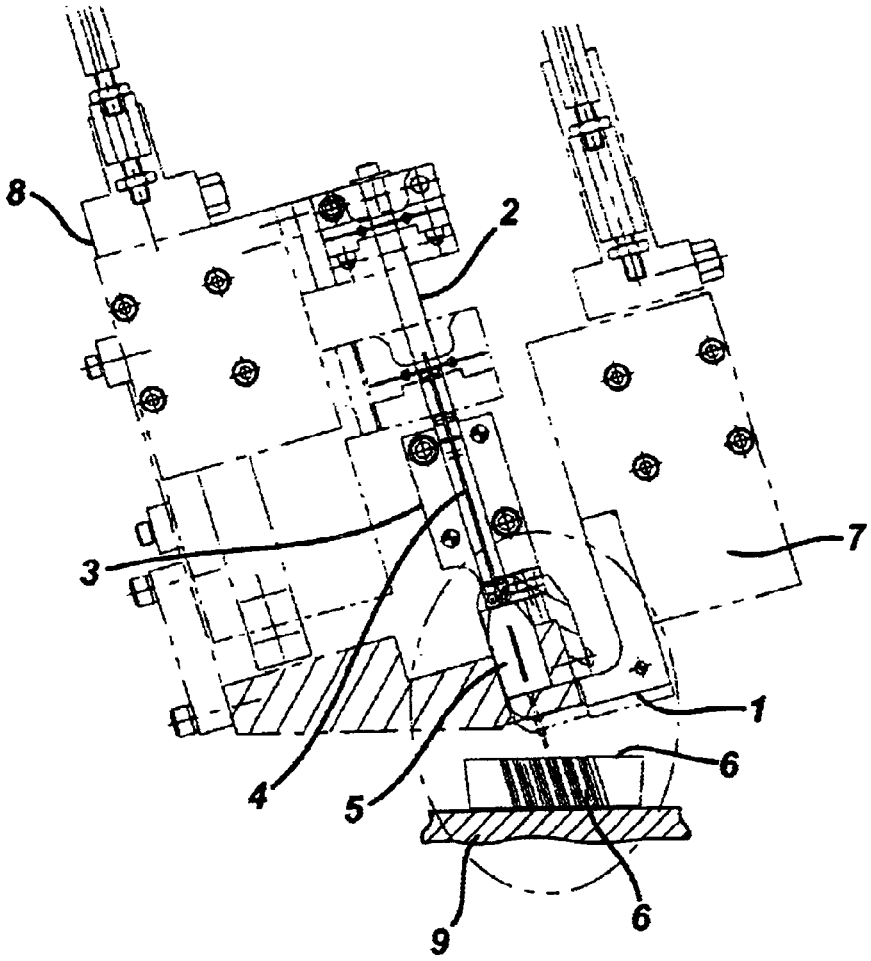
FIG. 2 is a side view of a movable tuft stitching head in accordance with the invention positioned to transfer bristle tufts from a tuft carrier to the tuft insertion chambers of a brush mold.
Figure 3:
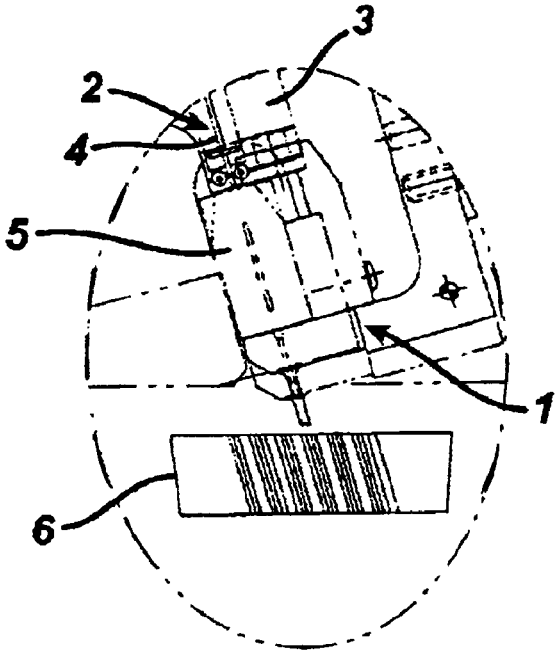
FIG. 3 is a magnified side view of a movable tuft stitching head in accordance with the invention showing direct mechanical insertion of a tuft held in a tuft carrier into a tuft chamber of a brush mold using a pushpin, a pushpin guide and a movable tuft insertion guide.
Figure 4:
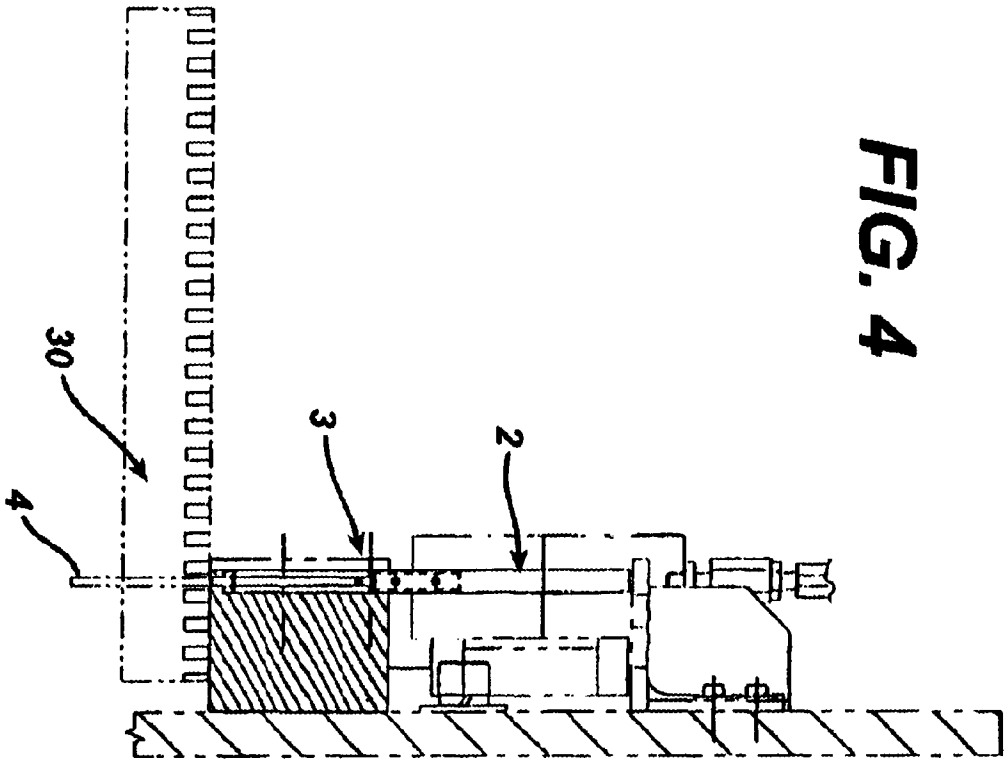
FIG. 4 is a side view of a tuft stitching apparatus in accordance with the invention showing a tuft carrier, a tuft in a cavity of the tuft carrier, and a pushpin attached to a pushpin drive, illustrating coaxial alignment of the pushpin, pushpin guide, tuft carrier cavity and tuft.

FIGS. 2, 3, and 4 together illustrate stitching apparatus and the method of using the same.

As shown in FIG. 4, a tuft carrier 30 filled with tufts is advanced into the mechanical insertion device using a tuft carrier feed, preferably a screw feed mechanism adapted to engage with a keyway on the tuft carrier. Preferably, one revolution of the screw advances the tuft carrier to the next tuft position. Preferably, a sensor detects empty cavities in the tuft carrier (rejected tufts) and a cavity is skipped in the tuft insertion process. Once a tuft carrier cavity with a tuft is located at the insertion position, a push pin 4 which is attached to a pin holder 2 and guided by a pin guide 3 is lowered on top of the tuft and pushes the tuft into the tuft insertion guide 1 shown in FIGS. 2 and 3. Than tuft insertion guide 1 and push pin 4, each attached to attached to a drive mechanism 7 and 8 (FIG. 2), are lowered at the same speed to the brush mold 6 (FIGS. 2 and 3, FIG. 3 being a magnified view of the stitching head shown in FIG. 2)) in which the tuft has to be placed.

At a specified distance from the brush mold top, the tuft insertion guide stops while the push pin keeps on driving the tuft through the tuft insertion guide into the brush mold. Once the tuft is seated in the brush mold 6, the tuft insertion guide 1 retracts to a raised position (home position), while the pin 4 stays in a lowered position in order to strip the tuft out of the tuft insertion guide 1. As soon as the lower end of the tuft insertion guide 1 and the lower end of the push pin 4 are flush (pin 4 is visible at the lower end of tuft insertion guide 1, as shown in FIGS. 2 and 3), both, pin 4 and guide 1 are retracted to a raised position.

The tuft carrier advances to the next position and the procedure is repeated until the brush mold 6 is filled with tufts. One method of advancing the tuft carrier is by using a screw feed engaging with a keyway on the tuft carrier. The tuft carrier feed may also provide a continuous stream of tuft carriers 30 to the tuft stitching head. The tuft carriers are preferably transported by a conveyor belt to the screw feed located at the tuft stitching head. The pitch of the cavities in the individual tuft carriers as well as the outer dimensions of the carriers are preferably chosen such that the sequence of carriers appears to be an endless tuft container for the tuft stitching apparatus.

The brush mold 6 is located on a movable mold positioning fixture 9 (FIG. 2). Preferably, the movable mold positioning fixture is a multi-axis table such as a two-dimensional x-y translation table. The movable mold positioning fixture presents the empty tuft chambers of the brush mold 6 to the stitching apparatus for tuft insertion. A pick and place unit (not shown) places the brush molds 6 on a movable mold positioning fixture that then presents the empty tuft chambers in the brush mold to the mechanical tuft insertion device at the tuft stitching apparatus. After the brush mold is fully loaded with bristle tufts, an unload pick and place removes the brush mold from the movable mold positioning fixture and attaches the mold to the molding head of a melt extrusion device. A molten polymer, e.g. a polymer at a temperature above the melting point of the polymer, is added to the brush mold. The mold is then cooled to a temperature below the polymer melting point, and a completed brush assembly is then removed from the brush mold. The movable mold positioning fixture returns to the load position where new (empty) brush molds are loaded for the next insertion sequence.

After passing through the tuft stitching apparatus, the tuft carriers are transported back to an empty tuft carrier filling station. If there is no demand for empty tuft carriers, the tuft carriers are pushed into an empty tuft carrier buffer having a design similar to a loaded tuft carrier buffer. On the way to the empty tuft carrier filling station, the tuft carriers may be inspected to make sure that all cavities are empty as well as to check whether the movable tuft clamps are still functional.

The invention enables direct mechanical control over the tufts at any point of the brush assembly process. This is gained by storing the tufts oriented in the tuft carriers and than inserting the tufts in an oriented manner by means of direct mechanical insertion into the tuft insertion chambers of a brush mold, using the push pin and the tuft insertion guide. This permits automated assembly of toothbrushes with a significantly reduced number of defective or missing bristle tufts. The invention has been demonstrated to increase the efficiency and reliability of the tuft insertion process to 98%.

Mechanical insertion of bristle tufts into the tuft chambers of a brush mold has been demonstrated at rates of 1 to 120 tufts/min. However, the tuft insertion rate can be readily varied, and can be easily increased to over 600 tufts/min simply by modifying the drive mechanisms of the tuft stitching apparatus to increase drive velocity.

In addition, the invention is independent of the tuft material used and tuft geometry. Different tuft shapes and lengths may be readily accommodated by altering the tooling and distances traveled by the push pin and guides. For example, the invention is able to handle different tuft shapes simply by changing the geometry of the insertion pin 4, the tuft insertion guide 1 and the tuft cavities in the tuft carriers 5, to match the dimensions and shape of the desired tufts.

Another feature of the present invention is the ability to insert tufts into tuft chambers of the brush mold at different angles, thereby creating a brush assembly having a bristle pattern defining a variety of angles relative to the brush body. The mechanical insertion device is mounted at a fixed angle therefore. Insertion of tufts at different angles is possible using a 4-axis table for the movable mold positioning fixture instead of a two axis x-y-table.

In contrast to the existing pneumatic processes for tuft handling and tuft insertion, where successful tuft insertion rates are generally well below 90%, the direct mechanical insertion method of the present invention permits over 98% of all tufts to be successfully inserted into the tuft chambers of the brush mold, provided that the tufts are made to specification. In addition, the present invention permits defective tufts to be readily identified and removed from the brush assembly process before insertion in the tuft chambers of the brush mold, thereby increasing the yield of defect free brush assemblies, and increasing the production efficiency of the brush manufacturing process. For example, defective tufts can be readily identified using optical inspection methods, and the tuft carrier diverted to a tuft rejection station where defective tufts are removed before non-defective tufts are transferred to the tuft insertion chambers of the brush mold.

A production buffer can also be provided for storing tuft carriers loaded with tufts before the tuft carriers are moved to the tuft stitching apparatus for direct mechanical insertion of the tufts into the tuft chambers of the mold. A production buffer permits the decoupling of tuft manufacturing steps from the brush molding step, thereby permitting tuft manufacturing to continue even when brush molding cannot occur due to disruptions occurring at the tuft stitching apparatus or at the brush molding step. In particular, bristle end fusing, end rounding and inspection for defects may be decoupled from the process of mechanical tuft insertion of the bristle tufts into the tuft chambers of a brush mold, thereby facilitating the use of computer controlled or automated brush assembly methods.

In accordance with the invention, a method of automated brush assembly can be provided as follows . A gripper, as described herein, is employed to form bristle tufts, which are transferred to a tuft carrier at a tuft carrier filling station, and subsequently mechanically inserted into the tuft chambers of a brush mold assembly at a tuft insertion station. In a preferred embodiment, one end of each bristle tuft is fused before the tufts are transferred to the tuft carrier. In a variation of this embodiment, the non-fused end of each bristle tuft is subjected to an end-rounding process, in accordance with the invention described herein, before the tufts are transferred to the tuft carrier. In a further variation of this embodiment, a sensor (e.g. a vision system) checks the tuft quality at the fused end of the tufts, before the tufts are transferred to the tuft carrier. In still another variation of this embodiment, a sensor (e.g. a vision system) checks the tuft quality at the unfused end of the tufts, before the tufts are transferred to the tuft carrier.

Once at the tuft carrier filling station, a pick and place device lowers the gripper and places the tufts into the tuft carrier. At this stage the tuft carriers that are about to get filled are in a tuft carrier indexer. The indexer positions a tuft carrier in alignment with the gripper such that each tuft held by the gripper is aligned with a cavity in the tuft carrier. The tuft carrier clamps are then opened, and the tuft ends inserted into individual cavities in the tuft carrier. The tuft carrier clamps are then closed, gripping the tufts and holding them in position within each respective cavity. The gripper is then opened, releasing the tufts.

In a preferred embodiment, one end of each tuft is pushed within the carrier such that the tuft end is made substantially flush with a face of the carrier. This is accomplished by partially opening the tuft carrier clamps while mechanically pushing against the exposed tuft end until the end is substantially even with a face of the tuft carrier.

After inserting each tuft into an individual cavity in the tuft carrier, the gripper relaxes its grip on the tufts, and a pusher bar seats the tufts flush to the top of the tuft carriers.

A key feature of the tuft carrier is its ability to facilitate automated assembly of brushes that combine end-rounded and non-rounded bristle tufts. This feature is enabled by transporting individual tuft carriers, carrying either end-rounded bristle tufts or non-rounded tufts, to a tuft insertion station (mechanical tuft stitching apparatus) in an automated assembly line. Preferably, a conveyor belt is used to transport the tuft carriers in the desired insertion sequence. Most preferably, additional tuft inspection and defective tuft rejection steps are employed while the tuft carrier is moving between the tuft carrier loading position and the tuft stitching apparatus.

For example, once the tufts are loaded in the tuft carriers, a pick and place device pushes the tuft carriers onto a conveyor belt that connects to a loaded tuft carrier buffer. In one variation of this embodiment, the pick and place device is capable of only horizontal motion. While pushing out each filled tuft carrier, the pick and place device advances the tuft carrier locations that carry unacceptable tufts (previously identified by the two tuft inspection sensors) to a single tuft reject station. This station consists of a push pin that pushes unacceptable tufts through the bottom of the tuft carrier into a vacuum chute. In the event that more than a critical number of tufts is found to be unacceptable, or that one or more tufts are not seated flush to the top of the tuft carrier, the whole tuft carrier is rejected at this tuft rejection station. This is accomplished by leaving the tuft carrier in the precision indexer until the entire carrier is pushed out in the next cycle when the pick and place inserts a new tuft carrier loaded with tufts.

If the tuft insertion machine (tuft stitching apparatus) has demand for tufts, the tuft carriers are transported to the tuft stitching apparatus. If there is no demand, the tuft carriers are pushed into a loaded tuft carrier buffer consisting of a plurality of magazines capable of holding carrier bars. In case a fault condition exists at the bristling module or maintenance has to be carried out upstream of the tuft stitching apparatus, the insertion part of the apparatus is fed by tuft carriers taken from the loaded tuft carrier buffer. Preferably, sufficient bristle-laden tuft carriers for at least one hour of assembly line operation are stored in this buffer.

On the way to the tuft carrier buffer, the tufts are preferably pneumatically seated further down in the tuft carrier using air applied through nozzles mounted at the conveyor.

The invention further features a method of forming a tufted brush head in a brush mold. The method includes the steps of:

providing a brush mold, wherein the mold defines a brush head cavity, and the brush head cavity defines a plurality of tuft insertion chambers;

providing a plurality of bristles as tufts held in a movable gripper, wherein each of the bristles and each of the tufts has two ends;

transferring the tufts to a movable tuft carrier having a top face, a bottom face, and a plurality of cavities extending between the faces, wherein the carrier is adapted to hold a plurality of tufts as an arrangement of individual tufts within the cavities;

moving the mold and the tuft carrier to a tuft stitching apparatus adapted to mechanically transfer the tufts to the tuft insertion chambers; and mechanically transferring at the tuft stitching apparatus at least one of the tufts from the carrier to at least one of the tuft insertion cavities.

The method may preferably further comprise any of the following steps, as discussed herein:

Fusing at least one end of each tuft; fusing one end of each tuft while the tufts are held in the gripper; end-rounding at least one end of the bristles while the tufts are held in the gripper; pushing one end of the tufts within the carrier such that each tufts is made substantially flush with a face of the carrier; temporarily storing the tuft carrier in a tuft carrier buffer before moving the tuft carrier to the tuft stitching apparatus; or inspecting the tufts for defects while the tufts are held in the gripper. In those embodiments wherein tufts are inspected for defects while the tufts are held in the gripper, the method preferably comprises the step of removing defective tufts from the tufts carriers before moving the tuft carrier to the tuft stitching apparatus.

The invention also features a method of forming a brush assembly. The method includes the following steps, as described herein:

providing a brush mold defining a plurality of tuft insertion chambers;

providing a plurality of tufts arranged in a movable gripper;

transferring the tufts from the gripper to a movable tuft carrier;

transferring at least one tuft from the tuft carrier to at least one of the tuft insertion chambers by direct mechanical insertion, whereby a single tuft is inserted in each of the tuft insertion chambers.

adding a polymer having a melting point to the brush mold at a temperature above the melting point;

cooling the mold to a temperature below the melting point; and removing a completed brush assembly from the brush mold.

A number of embodiments of the invention have been described. Other embodiments are within the scope of the following claims.

What is claimed is:

1. A tuft carrier comprising a) a body having an upper face, a plurality of side faces, and a lower face, wherein said body defines a plurality of cavities extending between said upper face and said lower face; and b) a plurality of movable clamps connected to said body, wherein each of said clamps is adapted to move in-relation to one of said cavities at said upper or lower face and to at least partially occlude one of said cavities, said clamps being spring loaded.

2. A tuft carrier according to claim 1, wherein said cavities are linearly arranged.

3. A tuft carrier according to claim 1, wherein said cavities are tapered between said upper face and said lower face.

4. A tuft carrier according to claim 1, wherein said cavities have a shape selected from the group consisting of oval, triangular, and rectangular.

5. A tuft carrier according to claim 1, wherein each of said clamps defines an opening, and each of said clamps is adapted to permit alignment of said opening with one of said cavities when said clamp is open.

6. A tuft carrier according to claim 1, further comprising a keyway.

* * * * *